US005244106A

United States Patent [19]

Takacs

[11] Patent Number: 5,244,106

[45] Date of Patent: Sep. 14, 1993

[54] BOTTLE INCORPORATING CAP HOLDER

[76] Inventor: Peter S. Takacs, 3383 Valley View Dr., Santa Rosa, Calif. 95404

[21] Appl. No.: 803,100

[22] Filed: Dec. 5, 1991

Related U.S. Application Data

[63] Continuation-in-part of Ser. No. 652,657, Feb. 8, 1991, abandoned.

[51] Int. Cl.[5] ..... B65D 1/02; B65D 23/12

[52] U.S. Cl. ..... 215/100 R; 215/12.1; 220/744

[58] Field of Search ..... 215/1 R, 100 R, 100 A, 215/100.5, 6, 10, 11.1, 12.1, 2; 220/379, 744, 735, 740, 636; 206/509

[56] References Cited

U.S. PATENT DOCUMENTS

| | | | |
|---|---|---|---|
| 282,974 | 8/1883 | Fairchild | 215/2 X |
| 1,451,822 | 4/1923 | Hagerty | 215/11.1 |
| 1,635,070 | 7/1927 | Clark | 215/2 |
| 1,728,883 | 9/1929 | Simon | 215/6 |
| 2,041,563 | 5/1936 | Meinecke | 215/38 |
| 2,322,843 | 6/1943 | Deane | 220/906 X |
| 2,374,092 | 4/1945 | Glaser | 215/6 |
| 3,217,915 | 11/1965 | Weygandt | 215/10 |
| 3,402,844 | 9/1968 | Chin | 215/228 |
| 3,482,724 | 12/1969 | Heaton | 215/10 |
| 3,598,271 | 8/1971 | Holley | 215/100.5 X |
| 3,757,983 | 9/1973 | McCarthy | 215/10 X |
| 4,040,538 | 8/1977 | Gerson | 220/379 X |
| 4,416,373 | 11/1983 | deLarosiere | 206/509 X |
| 4,600,111 | 7/1986 | Brown | 215/6 |
| 4,761,379 | 8/1988 | Willims et al. | 215/100 R X |
| 4,798,300 | 1/1989 | Ghosh et al. | 215/10 |
| 4,804,096 | 2/1989 | Harding | 215/228 |
| 4,829,618 | 5/1989 | McKee | 248/346.1 X |
| 4,872,597 | 10/1989 | Hanafusa | 220/379 X |
| 4,928,848 | 5/1990 | Ballway | 220/444 |

FOREIGN PATENT DOCUMENTS

| | | | |
|---|---|---|---|
| 117191 | 6/1943 | Australia | 215/1 R |
| 704752 | 3/1965 | Canada | 215/11.6 |
| 529685 | 7/1931 | Fed. Rep. of Germany | 215/100 R |
| 1007178 | 2/1952 | France | 215/1 R |
| 1022291 | 3/1953 | France | 215/2 |
| 1150963 | 8/1957 | France | 215/100 |
| 1524889 | 5/1968 | France | 215/10 |
| 1551924 | 1/1969 | France | 215/10 |
| 330424 | 7/1958 | Switzerland | 215/10 |
| 560632 | 4/1975 | Switzerland | 215/DIG. 7 |
| 259040 | 10/1926 | United Kingdom | 215/10 |
| 307049 | 10/1929 | United Kingdom | 215/1 R |

*Primary Examiner*—Sue A. Weaver
*Attorney, Agent, or Firm*—Douglas E. White

[57] ABSTRACT

A bottle includes a top with a removable cap having a height; includes a bottle base, the rim of which defines a plane at the lowermost extremity of the bottle for resting the bottle on a planar surface; and includes a cap well or recess formed in the bottle base. The cap well has a depth at least as great as the height of the cap, wherein the cap, when placed in the cap well, is securely gripped thereby and does not project down beyond the plane of the base of the bottle.

7 Claims, 3 Drawing Sheets

BOTTLE INCORPORATING CAP HOLDER

RELATED APPLICATION

This application is a continuation-in-part of applicant's application Ser. No. 07/652,657, filed Feb. 8, 1991, entitled BOTTLE WITH CAP HOLDER, now abandoned.

FIELD OF THE INVENTION

This invention relates to fluid containers, more particularly to a beverage bottle having a well or recess in its base for temporarily holding its cap.

BACKGROUND OF THE INVENTION

While consuming bottled beverages, one confronts a dilemma with respect to the cap. If one sets aside the cap, it may become misplaced or otherwise unavailable if later needed to re-seal a bottle whose contents have been only partially consumed. If the bottle is drained and discarded, the cap must be retrieved from its place of temporary storage and separately discarded. If one has moved around with one's beverage while consuming it, the cap may be some distance away.

More significant, perhaps, is the possibility that the bottle cap, being a small and seemingly insignificant item, will not be disposed of properly. Billions of thoughtlessly discarded bottle caps are, in the aggregate, a significant environmental pollution problem. For beverage cans, this problem largely has been solved through the use of "pop-tops" that remain attached to the can after opening.

The present invention provides a somewhat analogous remedy for the problem of holding and disposing screw-off or pry-off caps of glass or plastic bottles. It furnishes a means for the user to attach the cap to the bottle so that the cap is readily available for reuse or so that the two automatically will be discarded together without further effort.

Felt tip markers are known which have recessed wells in the end opposite from the tip, which wells are used for temporarily storing the cap while the marker is in use. However, the cap protrudes from the well out beyond the end while so stored. This is not a problem, because the diameter of the cap is so large (relative to the end in which it is stored) that, while the cap is in the recess, the marker may be stood stably upright on the cap itself just as easily as it may be stood on end without the cap in the recess.

The problem with providing a well in the base of a beverage bottle like that of marking pens is that the diameter of the cap is usually quite small when compared to that of the bottle. Therefore, allowing the cap to protrude from the well down out beyond the base will not do—the bottle will thereby be rendered unstable.

Merely providing a well in the base having the same size and shape as the cap also will not do—means must be provided for grasping the cap so that it may be removed from the well.

Prior developments in this field may be generally illustrated by reference to the following patents:

| Patent No. | Patentee | Issue Date |
|---|---|---|
| 3,402,844 | W. Chin | Sep. 24, 1968 |
| 2,041,563 | C. Meinecke | May 19, 1936 |
| 4,928,848 | J. Ballway | May 29, 1990 |

-continued

| Patent No. | Patentee | Issue Date |
|---|---|---|
| 4,804,096 | C. Harding | Feb. 14, 1989 |
| 560,632 Swiss | A. Borgeaud | Dec. 01, 1973 |
| 3,598,271 | D. Holley | Aug. 10, 1971 |

U.S. Pat. No. 3,402,844 teaches a bottle having a base stand 18 that alternatively functions as a cap. There is a recess or well 16 in the base of the bottle which is designed to hold this enlarged inversion stand. Nevertheless, the recess could almost hold the separate top cap 14, as a hypothetical alternative, although this is not within the teachings of that patent. In any event, measurement of the figures of that patent shows that even if the cap 14 of this bottle were used in this unintended manner, cap 14 would protrude out slightly from the well, so that the bottle would be rendered unstable. Furthermore, no means is provided for reaching inside the underside of the bottle to grasp and remove the contents of the well. This is logical, given that the base stand of that patent is in fact designed to protrude out beyond the bottle base, in order to be readily grasped at the sides of the bottle.

U.S. Pat. Nos. 2,041,563, 4,928,848 and 4,804,096 teach lids of containers that are designed also to fit on the bases of the containers.

FIG. 13 of Swiss Patent 560,632 shows a recess in the base of a cup, but it is far too small to hold any cap that would fit on the open top. FIG. 12 therein indicates that the purpose of this recess is actually to act as a stopper for a bottle 26.

U.S. Pat. No. 3,598,271 teaches another lid for the top of a cup that is designed also to fit on the base of the cup.

SUMMARY OF THE INVENTION

The present invention is a well or recess in the end of any container for storing beverages or other fluids (such as a bottle, can, or carton made of glass, plastic, metal, cardboard, paper or the like), which well is of sufficient depth so that, when the container's single cap is removed from the top thereof and temporarily stored within the well, the cap does not protrude out down beyond the base end of the container. In other words, the overall depth of the well exceeds the height of the cap. The cap well may generally be of the same shape as the cap (at least at the upper end of the well) but is of the same or slightly smaller width or diameter, so as to grip the cap securely by means of friction.

While the cap and the cap well would ordinarily both be cylindrical, either could be formed of any shape. In particular, the cap and well could each have different shapes, as long as their circumferences meet and are compressed together at at least two points. For example, if the cap were circular in cross section and the well triangular, the cap could be held in the well by touching it along only three points—one in the center of each side of the triangle. The cap and its well need only have a portion of the vertical wall of each which is substantially congruent with, immediately adjacent to, and compressed within, a portion of the vertical wall of the other, in order for the cap to be stored and held in the well.

The bottom end of the well may have an annular expansion, or have opposed side wells, within which to insert one's fingertips when one desires to grasp and remove the cap from the main cap well in order to replace it on the top or neck of the container.

The invention allows one to temporarily store the cap in the base of the container while the container is in use, and, at the same time, to set the container on its base, without thereby making the container any less stable.

Molded glass beverage bottles having plastic screw-off caps constitute the preferred containers. However, the invention could be practiced, for example, with beer bottles having standard crimped metal pry-off or screw-off caps, as well as with many other containers, such as jam jars, plastic syrup bottles, and water jugs, to name just a few.

FEATURES AND ADVANTAGES

An object of this invention is to provide a bottle which includes a neck with a removable cap having a height. The cap is of the standard type, i.e. it has an interior cavity opening outward at one end of the cap, the cavity forming an interior surface of the cap into which cavity fits the neck. The bottle includes a bottle base, the rim of which defines a plane at the lowermost extremity of the bottle, for resting the bottle on a generally horizontal surface. It has a single glass wall forming the neck and the base and it includes a cap well or recess formed in the base by the wall having a depth at least as great as the height of the cap, wherein the cap, when placed in the cap well, is securely gripped by the cap well and does not project down out beyond (i.e. lower than) the plane of the base of the bottle. The cap well may be said to have at least a first circumference. The cap may have any shape, as long as the cap well has a shape which is configured so as to be able to receive the cap within the well. A second circumference is defined about the exterior surface of the cap, at least one portion of which second circumference is substantially congruent with, immediately adjacent to, and compressed within, at least one portion of the first circumference when the cap is removed from the neck and placed in the cap well.

A further object is to provide a bottle wherein the depth of the cap well is greater than the height of the cap, wherein a gap is formed between the cap and the plane of the base when the cap is placed in the cap well.

Yet another object is to provide means for grasping the cap when the cap is in the cap well, for the removal thereof.

In accordance with the previous object, the cap-grasping means may be an annular finger well formed as a radial cavity expansion around substantially the entire circumference of the cap well.

Alternatively, the cap-grasping means may be a pair of opposed finger wells formed in the base of the container, which wells communicate with (i.e. lead or open up into) the cap well.

Alternatively, the cap-grasping means may be a lip formed on the cap itself.

Yet a further object is to provide a plastic cap holder permanently glued to the wall of a bottle at the base of the bottle, the cap holder having a cap holder base, at least one portion of which defines a plane at the lowermost extremity of the cap holder for resting the bottle on a planar surface. The cap holder also has a cap well formed in the cap holder base, at least one portion of which is substantially congruent with at least one portion of the cap, wherein the cap, when placed in the cap well, is securely gripped by the cap well and does not project down beyond the plane of the cap holder base.

Yet a further object is to disclose a method of storing, for reuse or disposal, a removable single cap of a bottle. The method includes, in serial order of performance, the steps of: 1) providing the bottle having a neck and having contents sealed when the cap is on the neck (i.e. as sold to the consumer); 2) providing in a base of the bottle, empty cap well means for gripping and storing the cap, the base having a lowermost plane, the cap well means being deeper than the cap is high, so that the cap does not project down below the lowermost plane of the bottle base when so gripped and stored in the cap well means; 3) removing the cap from the neck; and 4) placing the cap into the cap well means for temporary storage of the cap or for later disposal together of the cap and bottle.

Additional steps can include consuming the contents with the cap in the cap well means and disposing of the empty bottle with the cap in the cap well means.

Another object is to provide an apparatus which is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, the words "upwardly," "downwardly," "leftwardly," and "rightwardly" will refer to directions in the drawings to which reference is made, unless otherwise indicated. Similarly, the words "inwardly" and "outwardly" will refer to directions toward and away from, respectively, the geometric center of a device and designated parts thereof.

DRAWING REFERENCE NUMBERS

| | |
|---|---|
| D | depth from 17 to 24 |

-continued

| | |
|---|---|
| H | height of 8 |
| G | gap (D-H) |
| 1 | bottle |
| 3 | neck of 1 |
| 4 | threads of 6 |
| 5 | interior cavity of 8 |
| 6 | mouth opening of 1 |
| 7 | wall of 8 |
| 8 | cap |
| 10 | wall of 1 |
| 14 | base of 1 |
| 16 | cap well in 14 |
| 17 | lower face of 16 |
| 18 | finger well in 14 |
| 20 | finger well in 14 |
| 22 | concave face of 14 |
| 24 | flat rim of 14 |
| 101 | bottle |
| 104 | threads of 106 |
| 106 | mouth opening of 101 |
| 107 | wall of 108 |
| 108 | cap |
| 109 | lip of 108 |
| 110 | wall of 101 |
| 112 | cap holder |
| 113 | base of 112 |
| 114 | base of 101 |
| 116 | cap well in 113 |
| 117 | lower face of 116 |
| 118 | finger well in 113 |
| 119 | wall of 112 |
| 124 | flat rim of 113 |
| 208 | cap |
| 209 | lip of 208 |
| 211 | stem for 209 |
| 308 | cap |
| 309 | tabs of 308 |
| 407 | wall of 408 |
| 408 | cap |
| 409 | lip of 408 |
| 411 | groove for 409 |
| 501 | bottle |
| 504 | threads of 506 |
| 506 | mouth opening of 501 |
| 507 | wall of 508 |
| 508 | cap |
| 509 | ring of 508 |
| 510 | wall of 501 |
| 514 | base of 501 |
| 516 | cap well in 514 |
| 517 | lower face of 516 |
| 518 | finger well in 514 |
| 524 | rim of 514 |
| 527 | top of 508 |
| 528 | bottom of 508 |
| 529 | retainer of 508 |
| 601 | bottle |
| 608 | cap |
| 616 | cap well |
| 618 | finger well |

DESCRIPTION OF A PREFERRED EMBODIMENT

Figure 1:
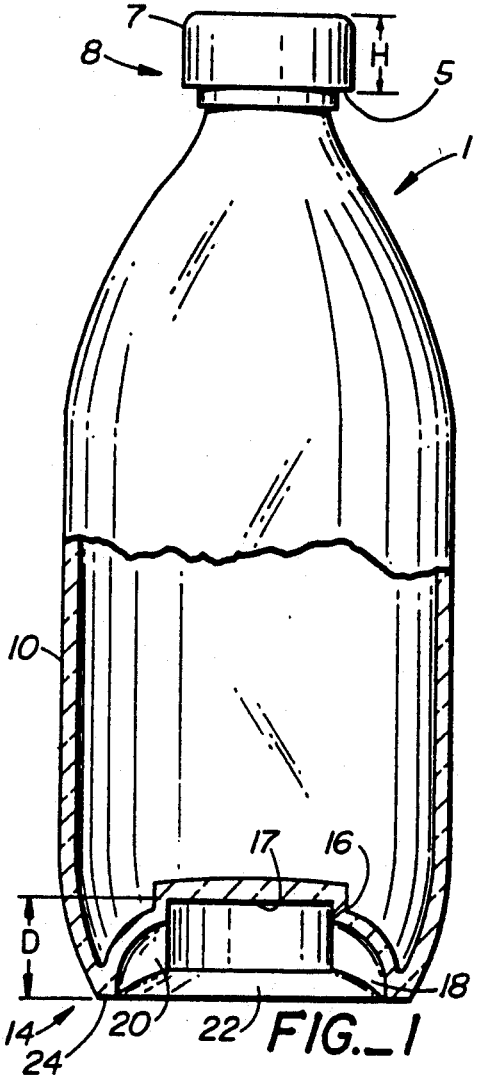
FIG. 1 is a partially-sectioned front elevation of a first embodiment of this invention, showing a bottle with its cap in a first position.

Referring to FIG. 1, there is illustrated therein a first cap-holding bottle 1 of this invention. The generally cylindrical single wall 10 of the bottle tapers to a neck 3. The neck terminates in a mouth opening 6, which mouth area of the neck bears threads 4. A plastic cap 8 has a vertical cylindrical wall 7 forming a outwardly and downwardly opening interior cavity 5, into which cavity fits the neck 3. On the interior surface of the cavity 5 are matching threads (not illustrated). For convenience of reference, the exterior surface of the cap 8 shall be considered to comprise the radially outermost surface of the wall 7 and not the threaded interior surface of the cap cavity 5.

The other end of the bottle is a base area, generally designated 14, which normally is bounded by a flat horizontal rim-ring 24. In many containers, for example, glass bottles, the base 14 and the neck 3, as well as the remainder of the container, are formed of a single wall 10 of more or less uniform thickness. The rim 24 defines a plane at the lowermost extremity of the base 14 (and of the bottle 1) for resting the bottle on a generally flat, generally horizontal surface such as a table top. In the center of the very slightly upwardly concave face 22 of the base is a downwardly opening cylindrical cap well 16 which comprises cap well means for gripping and storing the cap. While the face 22 does not have to be upwardly concave, it is to be noted that it is normally so in prior art bottles. As sold, the cap well 16 preferably is empty. The bottle 1 is sold filled with fluid contents. The face 17 seals the cap well 16 from the contents of the bottle.

Figure 2:
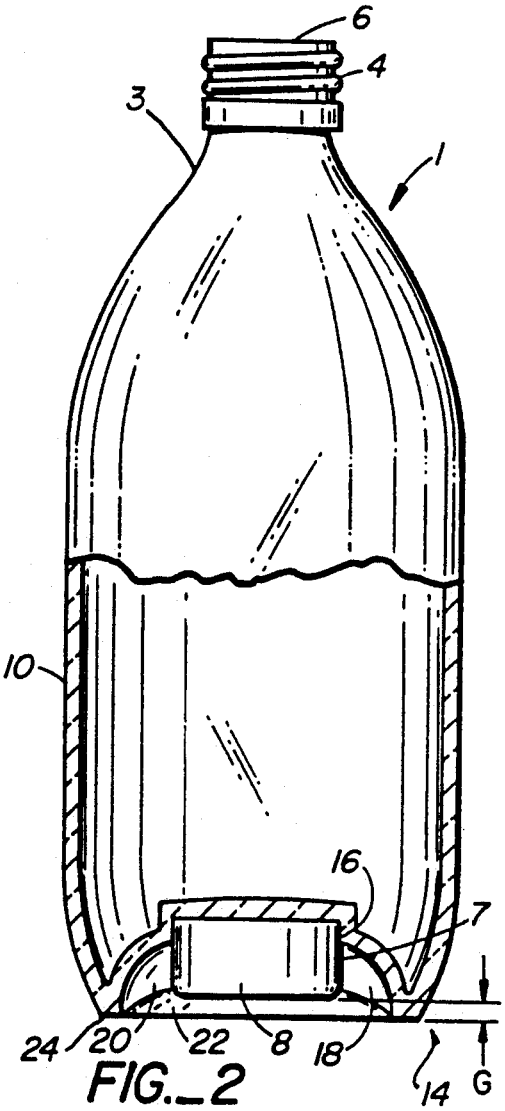
FIG. 2 is a partially-sectioned front elevation of the bottle of FIG. 1, showing the cap in a second position.

The vertical distance or depth D from the flat horizontal lower face 17 of the cap well 16 to the plane of the rim 24 of the base 14 of the bottle 1 is greater than the height H of the cap 8. As can be seen in FIG. 2, this results in the cap being fully recessed within the base 14 when it is removed from the mouth opening 6 and pressed into the cap well 16. No portion of the cap extends down beyond the plane of the rim 24 of the base, in order that the bottle will rest securely on the flat rim 24 when it is placed on a table top or other flat surface.

The maximum width of the cap well 16 (or, when circular, the maximum diameter thereof) substantially equals the maximum width of the cap 8. Insofar as the neck 3 of the bottle 1 screws within the cavity 5 forming the interior surface of the cap 8, the maximum width of the bottle neck 3 will be considerably smaller than the maximum width of the cap 8 (i.e. smaller by at least twice the thickness of the vertical wall 7 of the cap 8).

It is important to consider, when calculating critical dimensions, that the cap well 16, broadly speaking, includes the concavity of the face 22, insofar as any recessed depth in that face will add to the necessary overall depth D available for storing the cap 8.

Allowance in the cap well depth D should be made so that a gap G remains when the cap 8 is inserted in the well (i.e. $D-H=G$). In that case, the bottle will be stable even should the resting surface be somewhat irregular (e.g. should dirt particles, a coin, or the like, get trapped under the bottle). This clearance also aids stability in cases where the cap is not fully inserted into the cap well.

One also can merely partially insert the cap 8 into the cap well 16 and, thereafter, press it and the base of the bottle onto a flat surface. The cap will then move upward under pressure from the flat surface until it becomes stably seated at least to the level of the rim 24 and securely gripped by the cap well. Another very convenient method of capturing the cap 8 in the cap well 16 is first to place the cap on a flat surface and then to set the bottle down on top of it. This will automatically seat the cap flush with the base rim 24 and need involve the use of only one hand.

Once gripped in the cap well 16, the cap 8 may be stored there, out of the way. The circumference (or outer periphery) of the upper portion of the exterior of the vertical wall of the cap well ("exterior" in the sense that, while inwardly directed, it forms the outside of the bottle overall) is substantially congruent with and substantially equal to the immediately adjacent circumference (periphery) of the exterior surface of the wall 7 of the cap. The former circumference may either be substantially equal to the latter or, preferably, be slightly smaller. Therefore, a compressive force will create friction, which friction will securely grip and hold the cap 8 in the well 16 when the bottle is lifted. Even if the circumferences are substantially equal, friction will still hold the light cap in the well—compressive friction will be created, for example, by slight surface irregularities generated in the molding process.

Therefore, when it is said herein that a cap well has at least one circumference or portion substantially congruent with and substantially equal to (or slightly smaller than) at least one corresponding circumference or portion of a cap, it is to be understood that the circumferences or portions are to be matched to the extent that the cap may be freely inserted into the well, yet fit tightly enough therein so as to be gripped and stored until grasped by the user's fingers for removal. The cap 8 is light—it needs only to be gripped securely enough to prevent it from falling out of the cap well 16, due to its own weight, as the bottle 1 is lifted. For this, it probably is not necessary to have the surface of the well contact the cap along its entire circumference.

Alternate cap well gripping and storing means might comprise, for example, a well having tabs directed radially inward or other significantly protruding surface irregularities, which tabs or irregularities would be the only portions of the well that would actually contact portions of the cap. This would be equivalent to the preferred cap well means, even though the overall circumference of such a well might then be greater than that of the cap (except at the contacting portions) and even though the two circumferences might not then be congruent (again, except at the contacting portions).

A protruding lip on a cap can also be used to keep the cap securely gripped and stored in a cap well, as discussed below in connection with FIGS. 8 and 9.

If the user consumes the entire contents of the bottle 1 in one serving, disposing of the bottle will automatically dispose of the previously stored cap 8. If, however, the user wishes to re-seal the bottle—in order to protect the contents or to preserve carbonation for later servings—the cap remains accessible in the cap well 16 for ready retrieval, even should the bottle be moved from the location at which it was opened.

Figure 3:
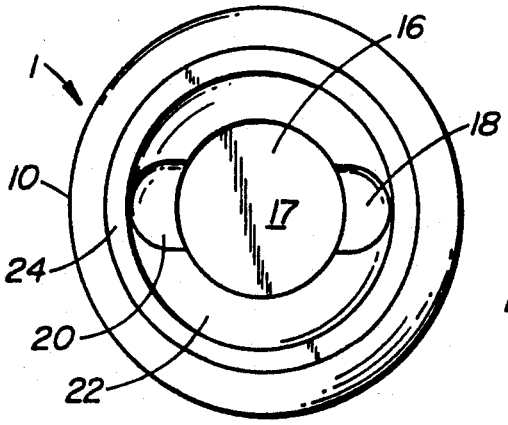
FIG. 3 is a bottom view of the bottle of FIG. 1 in the first position.

There usually is not a great deal of room at the base 14 of the bottle 1. Provision should be made for means for grasping a stored cap 8, in order that it may be removed for re-use. Turning to FIG. 3, it can be seen that the cap well 16 may expand or open out into a lateral pair of opposed finger wells 18, 20. The cap well is preferably centered about the central axis of the generally cylindrical bottle 1. The finger wells 18, 20 open radially outward toward the vertical outer wall 10 of the bottle. They taper upwardly and inwardly to join or merge into the cap well and may be curved concavely, as illustrated. This configuration allows easy, comfortable and ergonomic access to the user's fingertips, naturally directing the fingertips toward the side wall 7 of the stored cap. Once so grasped between two fingers, the cap easily may be pried out of the cap well.

As noted above, the cap well 16 is of a shape congruent with that of the cap 8 (at least with those portions of the latter which do not project downwardly out of the constricted top of the former), but the well 16 may be slightly undersized. Therefore, the cap 8 is held within the cap well 16 solely by a slight compressive force. It may readily be removed by the fingers, even should they have only relatively slight purchase.

Figure 4A:
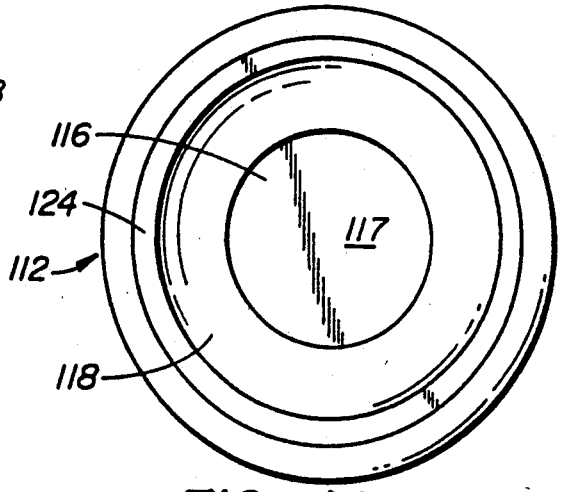
FIG. 4 is a partially-sectioned front elevation of a second embodiment of the invention, FIG. 4A being a bottom view thereof.
Figure 4:
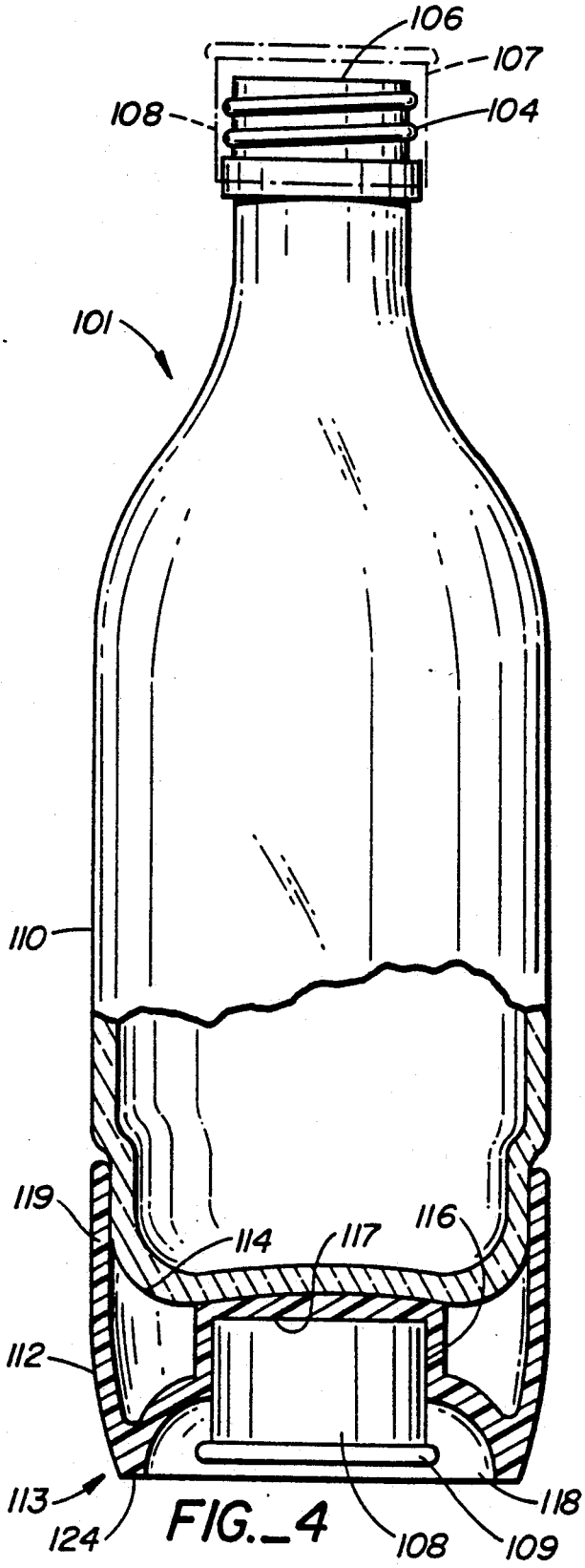

FIG. 4 illustrates a second embodiment of the invention, a bottle 101 in which the cap well gripping and storing means and the cap-removal grasping means are varied from that of the previous embodiment in several respects.

The cap well 116 is molded into a separate cap holder 112. This embodiment may be useful, for example, with plastic bottles, which bottles are commonly made by a blow-molding process that does not readily allow for precision molding in the base area. It is to be noted that, for convenience, the last two positions of the reference numerals of alternate embodiments of the invention duplicate those of the numerals of the embodiment of FIGS. 1-3, where reference is made to corresponding or equivalent parts.

The generally cylindrical wall 110 of the bottle 101 tapers to a neck terminating in a mouth opening 106 which bears threads 104. A plastic cap 108 has a vertical cylindrical wall 107, on the surface of the interior cavity of which are matching threads (not illustrated).

A molded plastic cap holder 112 is permanently attached to the other end of the bottle. The plastic cap holder 112 has a cap holder base area, generally designated 113, bounded by a flat horizontal rim-ring 124. In the center of the base 113 of the cap holder is a downwardly-opening cylindrical cap well 116. Once again, when the cap 108 is inserted in the cap well, as shown in FIG. 4, no portion of the cap extends down beyond the plane of the rim 124 at the lowermost extremity of the cap holder base. Therefore, the bottle 101 will rest securely on the flat rim 124 when it is placed on a table top or other flat surface. The well 116 is preferably deep enough, between its flat lower face 117 and the holder base rim 124, to allow a gap for clearance between the top of the stored cap 108 and the holder base rim.

Instead of the pair of individual finger wells which are found in the previous embodiment, the cylindrical cap well 116 opens or expands radially outward into a single finger well 118, which latter well comprises a concentric recessed ring or annulus formed about the axis of the bottle, as perhaps best seen by comparing FIGS. 4 and 4A.

The user's fingers may enter the finger well 118 from any position in order to grasp the wall 107 of the cap 108 and, for this reason, an annular finger well, such as well 118, will generally be preferred. This finger well opens radially outward toward the wall 119 of the cap holder. It tapers upwardly and inwardly from the vicinity of the holder base rim 124 to meet and merge into the cap well 116. It may be smoothly curved into an upwardly concave form, as illustrated. The finger well 118 constantly contracts in diameter upward from the plane of the base 113.

Such an annular well (i.e. extending 360 degrees around the cap well) may be substituted for the bounded pair of finger wells of the previous embodiment in glass bottles, as well as in plastic. However, insofar as there is less area of contact between the exterior of the wall 107 of the cap and the exterior of the wall of the cap well 116, a tighter or more precise fit in the area of contact may have to be arranged. Nevertheless, it is anticipated that an annular well will be preferred for its ease of use, as noted above.

Again, the term "cap well" may be said to include, in combination, all integrated recesses in the base of a bottle (i.e. the upper cap-gripping portion, the finger well cap-grasping portion or portions, and any base face concavity) whose combined depth is equal to or greater than the height of the bottle cap.

The wall 119 of the separate cap holder 112 is permanently attached to the wall 110 of the bottle 101 by glue, heat welding, heat shrinking or the like. The top surface of the cap well 116 of the holder preferably presses up against the base 114 of the bottle, in order to help support the weight of the bottle. Since it is common to attach paper or foam-plastic product-identification labels to bottles (not illustrated), such labels may extend down over the gap between the bottle wall 110 and the holder wall 119, to disguise the gap and to further assist in fixedly securing the holder 112 to the bottle 101.

Standard forms of bottle caps, whether twist-off or pry-off, may be used in combination with this invention. However, removal of the cap from the cap well may be assisted by the construction of cap-grasping means directly on the cap —in addition to, or in replacement for, the finger well cap-grasping means. FIG. 4 shows one such cap modification, namely, a lip 109 which projects slightly outward horizontally from the circumference of the top of the cap 108. The lip 109 may be caught between the ends of the user's fingers or fingernails to further assist in cap removal.

Figure 5:
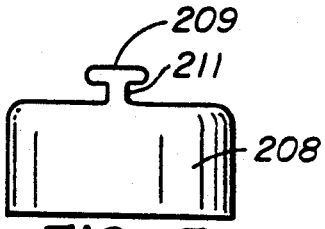
FIG. 5 is a front elevation of an alternate bottle cap.
Figure 6:
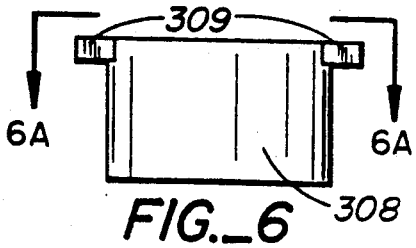
FIG. 6 is a front elevation of another alternate bottle cap, FIG. 6A being a plan view thereof.
Figure 7:
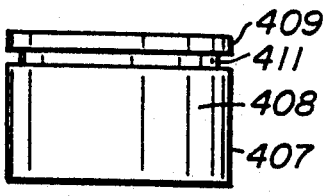
FIG. 7 is a front elevation of yet another alternate bottle cap.

FIGS. 5–7 illustrate other caps which have alternate embodiments of grasping means formed on the cap itself. Cap 208 (FIG. 5) has a stem 211 protruding upward from its top surface, which stem has a small disk or lip 209 that may be grasped by the user. While this embodiment can reduce or eliminate the need for separate finger wells, such as wells 18, 20, 118, it must be noted that the stem 211 and lip 209 add height to the cap, thereby necessitating an increase in the depth of any associated cap well.

Figure 6A:
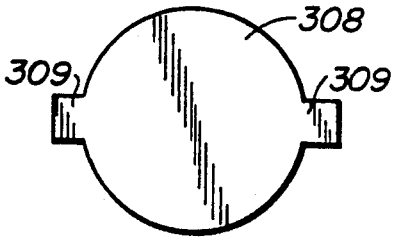

Cap 308 (FIGS. 6 and 6A) has a pair of lips or tabs 309. While they do not extend around the full circumference of the top of the cap, they otherwise function in the same manner as the lip 109 of the cap of FIG. 4.

Cap 408 (FIG. 7) is another acceptable alternative cap having integral grasping means. A circumferential groove 411 in the wall 407 of this cap creates a lip 409 which is graspable by the fingernails or which gives extra purchase to the fingertips through the introduction of a friction-generating irregularity. At the same time, the lip 409 does not protrude out beyond the cylindrical plane of the wall 407. Therefore, it conserves on the limited space which is available in the associated finger well or wells. Furthermore, like smooth-walled cap 8, cap 408 may be inserted into a cap well either right side up or upside down. A second groove could be added lower down the cap wall to account for both possibilities.

Figure 8:
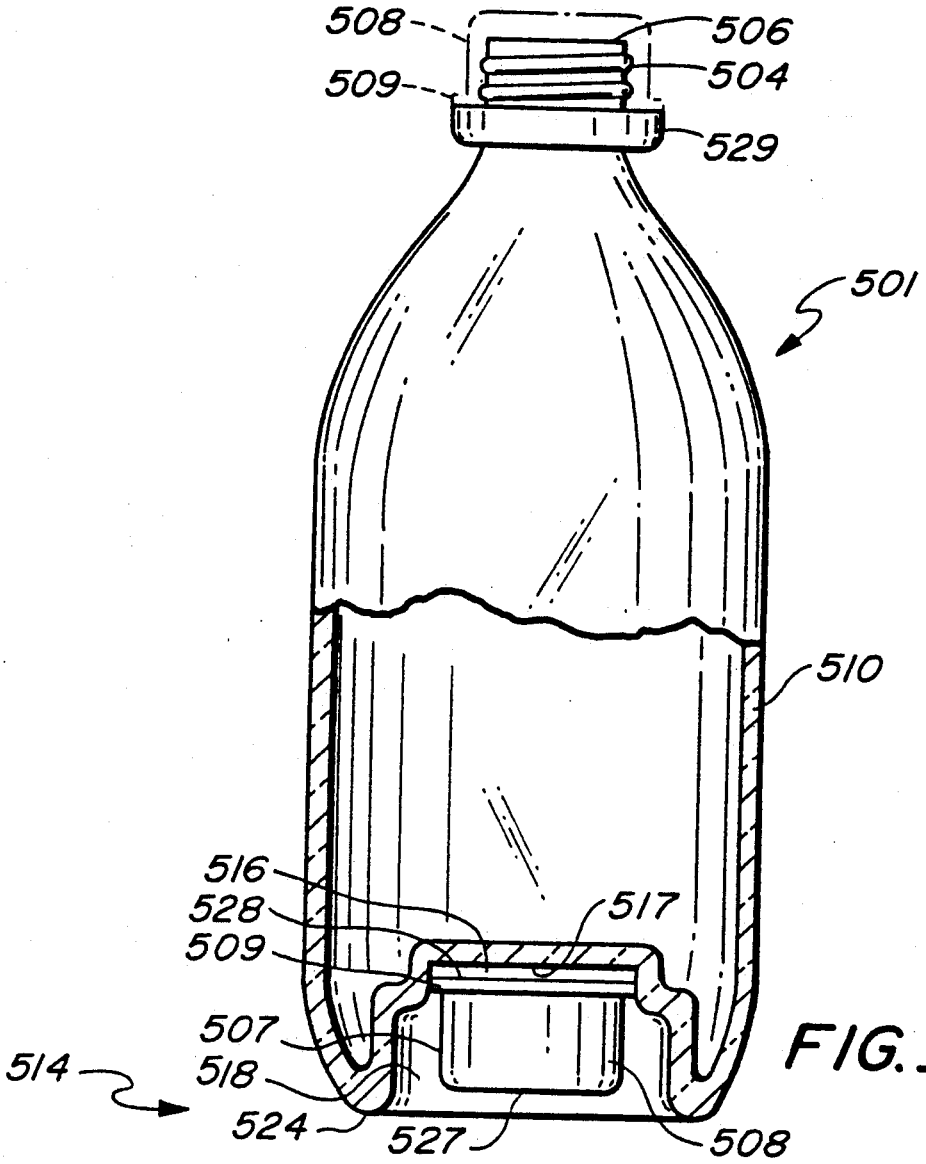
FIG. 8 is a partially-sectioned front elevation of an alternate bottle and a preferred alternate cap.

Referring to FIG. 8, there is illustrated therein another cap-holding bottle 501 of this invention. The wall 510 of the bottle tapers to a neck that terminates in a mouth opening 506, which opening bears threads 504. A plastic cap 508 has a vertical wall 507, on the interior cavity of which are matching threads (not illustrated).

At the other end of the bottle is a base 514, which base normally is bounded by a horizontal rim-ring 524. In the center of the base is a downwardly opening cap well 516 of this invention.

A pair of individual finger wells could be included, such as are found in the bottle of FIG. 3. However, preferably the cylindrical cap well 516 opens or expands outward into a single annular finger well 518. This latter well comprises a concentric recessed annulus formed about the axis of the bottle 501. Preferably, this finger well would curve concavely upward with a constantly shrinking diameter, in the manner of the finger well 118 of FIG. 4. However, the finger well 518 is shown generally cylindrical (except for the curved corners thereof) to illustrate the potential for alternate shapes of the wells disclosed herein.

A significant difference between this embodiment of the invention and the previous embodiments is that the bottle cap 508 has a circumferential ring or lip 509 on its bottom (i.e. open or cavity) end 528, rather than on its top (closed) end 527. This ring ensures that the cap has its maximum circumference at its open end. This cap embodiment may be preferred, if only because it is already found on a sizable portion of existing plastic bottle caps. It is formed when the cap 508 is broken away from its integrally-fabricated retainer ring 529. Therefore, adoption of this embodiment of the invention should not require extensive re-tooling of existing cap production and attachment equipment.

However, such a bottom ring 509 is advantageous for other reasons, as well. First of all, the upper portion of the cap well 516 may be sized so as to securely grip the ring 509, but not the smaller circumference of the vertical wall 507 of the cap 508. Therefore, the cap 508 will only fit in the cap well 516 with its open end 528 facing upward (toward the lower face 517 of the cap well), because when the cap is pushed in the well 516, only the circumference of the lip or ring 509 portion of the cap 508 will be congruent with, substantially equal to, immediately adjacent to and, therefore, compressible within, a corresponding circumferential portion of the cap well 516.

This may be the most sanitary cap configuration, in that it will help prevent the bottle-neck contacting surfaces of the cap 508 from becoming soiled. If the user tries to insert the cap with its open end 528 facing downward, the ring 509 will not enter the tight upper cap well area. Therefore, the cap will not seat with its interior cavity opening downward and exposed, but instead, will drop out.

Another reason a bottom ring 509 may be preferred, is that it allows for a vertically shorter upper well area. Indeed, there may be room for some extra clearance in that area for seating the short ring (for example, see the gap formed between the ring 509 and the lower face 517 of the cap well 516 shown in FIG. 8).

Figure 9:
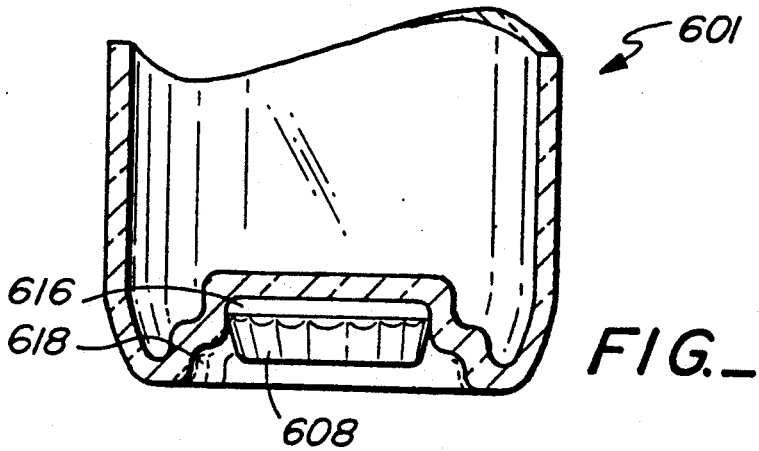
FIG. 9 is a broken-sectional front elevation of yet another bottle and a crimped metal cap of traditional design.

FIG. 9 shows a glass bottle 601—for example, a beer bottle—which uses a traditional crimped metal pry-off cap 608 (or, preferably, the newer, screw-off version of the traditional crimped metal cap). Such a crimped metal cap 608 may also be stored for re-use or disposal in a cap well 616 of this invention. A single annular finger well 618 enlarges the lower portion of the cap well 616. Like the cap 508 of the previous embodiment, the cap 608 may only be stored open-end up, due to the taper which forms in the cap when the cap is crimped. It can be seen in FIG. 9 that this taper forms a ring on the open end of the cup lock, which ring forms the maximum circumference of the cap. As with the ring 509 of the embodiment of FIG. 8, this ring is raised and projects radially outward when compared with the smaller-diameter closed end of the cap 608.

Another feature worth noting with respect to the bottles 501, 601 of FIGS. 8 and 9, respectively, is that the corners of the wells 516, 616, and of the associated portions of the bottle bases, are shown as being more rounded than is the case with previous embodiments.

Such rounding is perhaps more illustrative of the shapes actually produced by glass molding processes. However, the presence or absence of such rounded corners does not affect the invention disclosed and claimed herein.

While the above provides a full and complete disclosure of the preferred embodiments of this invention, various modifications, alternate constructions, and equivalents may be employed without departing from the true spirit and scope of the invention. Such changes might involve alternate materials, components, structural arrangements, capacities, sizes, operational features or the like. Therefore, the above description and illustrations should not be construed as limiting the scope of the invention which is defined by the appended claims.

What is claimed is:

1. Glass bottle apparatus including:

a neck having a single generally cylindrical cap removably affixed thereto, the generally cylindrical cap having an interior cavity forming an interior surface into which cavity fits the neck and an exterior surface of the cap formed outside of the cavity;

a base, at least one portion of which base defines a plane at the lower most extremity of the bottle, the neck and base being integrally formed together of on piece of material;

an empty cap well formed in the base having a generally cylindrical shape configured to be able to receive the cap within the cap well, at least one portion of which cap well is substantially congruent with, is immediately adjacent to, and compresses within itself, at least one portion of the exterior surface of the cap when the cap is removed from the neck and placed in the cap well, the cap well being deeper than the cap is high;

a first circumference of the cap well, which first circumference is slightly smaller in diameter than the diameter of a corresponding second circumference of the exterior surface of the cap, wherein the cap, when placed in the cap well, is securely gripped by the cap well and does not project down out beyond the plane of the base; and a finger well formed around the first circumference of the cap well, the finger well comprising a spherically concave enlargement of the cap well, for grasping the cap when the cap is in the cap well, to remove it therefrom.

2. In a bottle of the type sealable by a removable cap, the bottle having a bottle wall and a bottle base, the improvement comprising:

a plastic cap holder permanently attached to the bottle wall at the bottle base, the cap holder having a cap holder base, at least one portion of which defines a plane at the lowermost extremity of the cap holder for resting the bottle on a generally horizontal surface; and a cap well formed in the cap holder base having a shape configured to be able to receive the cap within the cap well, at least one portion of which cap well is substantially congruent with but slightly smaller than at least one portion of the cap and which compresses the cap when the cap is within the cap well so as to hold the cap in place there within, the cap well being at least as deep as the cap is high, wherein the cap, when placed in the cap well, is securely gripped by the cap well and does not project down beyond the plane of the cap holder base.

3. The bottle of claim 2 further including:

means for grasping the cap when the cap is in the cap well, for the removal of the cap; and wherein the cap holder is glued to the bottle wall.

4. The bottle of claim 3 wherein:

the cap well is deeper than the cap is high.

5. In a bottle of the type having a neck sealable by a removable cap, the bottle having a base defining a lower most plane thereof, the cap having one open end, the improvement comprising:

cap well means in the bottle base for gripping and storing the cap so that the cap does not project down below the lowermost plane of the bottle base when so gripped and stored;

a raised ring formed on the open end of the cap projecting radially outward therefrom and forming the maximum circumference of the cap;

and wherein the cap well means has at least one first circumference which is substantially congruent with, is substantially equal to, is immediately adjacent to, and compresses within itself, the ring of the cap.

6. Bottle apparatus including:

a neck having a single generally cylindrical cap removably affixed thereto, the generally cylindrical cap having an interior cavity forming an interior surface into which cavity fits the neck and an exterior surface of the cap formed outside of the cavity;

a base, at least one portion of which base defines a plane at the lower most extremity of the bottle, the neck and base being integrally formed together of one piece of material;

an empty cap well formed in the base having a generally cylindrical shape configured to be able to receive the cap within the cap well, the cap well being deeper than the cap is high;

a first circumference of the cap well, which first circumference is slightly smaller in diameter than the diameter of a corresponding second circumference of the exterior surface of the cap, wherein the cap, when placed in the cap well, is securely gripped by the cap well by compression and does not project down out beyond the plane of the base; and a finger well formed around the first circumference of the cap well, the finger well comprising a spherically concave enlargement of the cap well, for grasping the cap when the cap is in the cap well, to remove it therefrom.

7. Bottle apparatus including:

a neck having a single generally cylindrical cap removably affixed thereto, the generally cylindrical cap having an interior cavity forming an interior surface into which cavity fits the neck and an exterior surface of the cap formed outside of the cavity;

a base, at least one portion of which base defines a plane at the lower most extremity of the bottle, the neck and base being integrally formed together of one piece of material;

an empty cap well formed in the base having a generally cylindrical shape configured to be able to receive the cap within the cap well, the cap well being deeper than the cap is high;

a first circumference of the cap well which first circumference is slightly smaller in diameter than the diameter of a corresponding second circumference of the exterior surface of the cap, wherein the cap, when placed in the cap well, is securely gripped by the cap well by compression and does not project down out beyond the plane of the base; and a pair of opposed finger wells formed in the base of the bottle, which finger wells communicate with the cap well, for grasping the cap when the cap is in the cap well, to remove it therefrom.

* * * * *